US012234653B2

(12) United States Patent
Britton et al.

(10) Patent No.: US 12,234,653 B2
(45) Date of Patent: Feb. 25, 2025

(54) LINKABLE TILES FOR COVERING A SURFACE

(71) Applicants: Jeremy Britton, Riverside, CA (US); Jacob Olsson, Riverside, CA (US); Domanic Chu, Alhambra, CA (US)

(72) Inventors: Jeremy Britton, Riverside, CA (US); Jacob Olsson, Riverside, CA (US); Domanic Chu, Alhambra, CA (US)

( * ) Notice: Subject to any disclaimer, the term of this patent is extended or adjusted under 35 U.S.C. 154(b) by 64 days.

(21) Appl. No.: 17/969,347

(22) Filed: Oct. 19, 2022

(65) Prior Publication Data

US 2023/0045702 A1 Feb. 9, 2023

Related U.S. Application Data

(63) Continuation-in-part of application No. 16/879,659, filed on May 20, 2020, now abandoned, which is a continuation-in-part of application No. 16/736,371, filed on Jan. 7, 2020, now Pat. No. 10,711,467.

(60) Provisional application No. 62/936,470, filed on Nov. 16, 2019.

(51) Int. Cl.

| | |
|---|---|
| ***E04F 15/02*** | (2006.01) |
| *E04F 15/04* | (2006.01) |
| *E04F 15/10* | (2006.01) |

(52) U.S. Cl.

CPC .. *E04F 15/02005* (2013.01); *E04F 15/02038* (2013.01); *E04F 15/04* (2013.01); *E04F 15/105* (2013.01); *E04F 2201/0511* (2013.01); *E04F 2201/06* (2013.01)

(58) Field of Classification Search

None

See application file for complete search history.

(56) References Cited

U.S. PATENT DOCUMENTS

| | | | |
|---|---|---|---|
| 4,561,232 | A | 12/1985 | Gladden, Jr. et al. |
| 5,411,262 | A | 5/1995 | Smith |
| 9,181,717 | B1 | 11/2015 | Jamison |
| 9,890,540 | B2 | 2/2018 | Weitzer |
| 10,208,489 | B2 | 2/2019 | Walens et al. |
| 10,258,896 | B2 | 4/2019 | Ornstein et al. |
| 10,711,467 | B1 | 7/2020 | Britton et al. |

(Continued)

FOREIGN PATENT DOCUMENTS

| | | | |
|---|---|---|---|
| CN | 101260729 | A | 9/2008 |
| CN | 102146726 | A | 8/2011 |

(Continued)

OTHER PUBLICATIONS

China Patent Office, First Office Action, Dec. 3, 2021.

(Continued)

*Primary Examiner* — Alexander S Thomas

(74) *Attorney, Agent, or Firm* — Ryan Dean; Umberg Zipser LLP

(57) ABSTRACT

Various embodiments of tiles or devices that are used to create a structure used to cover a floor other surface are described. Preferred tiles or devices comprise one or more magnetized surfaces that may comprise one or more magnets or ferrous material. The magnetized surfaces can be used to magnetically couple adjacent tiles or devices to form the flooring or other structure. In some embodiments, the tiles or device may comprise one or more routed edges.

13 Claims, 6 Drawing Sheets

(56) References Cited

U.S. PATENT DOCUMENTS

| | | | | |
|---|---|---|---|---|
| 2002/0170259 | A1 | 11/2002 | Ferris | |
| 2005/0166513 | A1 | 8/2005 | Vanderhoef | |
| 2008/0202053 | A1 | 8/2008 | Guy et al. | |
| 2008/0213529 | A1 | 9/2008 | Gray et al. | |
| 2014/0220271 | A1* | 8/2014 | Meyer | B42D 1/00 428/34.3 |
| 2014/0227934 | A1 | 8/2014 | Rudisill | |
| 2016/0340912 | A1 | 11/2016 | Norris | |
| 2019/0013131 | A1 | 1/2019 | Smith et al. | |

FOREIGN PATENT DOCUMENTS

| | | | |
|---|---|---|---|
| CN | 203271063 | U | 11/2013 |
| CN | 206487110 | U | 9/2017 |
| CN | 108517976 | A | 9/2018 |
| GB | 2564104 | A | 1/2019 |
| JP | 2001349559 | A | 12/2001 |
| KR | 20110010826 | U | 2/2011 |
| KR | 2020110010826 | U | 11/2011 |
| KR | 200461450 | Y1 | 7/2012 |
| KR | 20130000650 | U | 1/2013 |
| KR | 2020130000650 | U | 1/2013 |
| KR | 101330389 | B1 | 11/2013 |
| KR | 200469749 | Y1 | 11/2013 |
| WO | 2018195002 | A1 | 10/2018 |

OTHER PUBLICATIONS

International Preliminary Report on Patentability for International Application No. PCT/US2020/012562 dated May 17, 2022; 9 pgs.

International Preliminary Report on Patentability for International Application No. PCT/US2020/060709 dated May 17, 2022; 8 pgs.

Korea Intellectual Property Office, International Search Report and Written Opinion, Aug. 13, 2020.

Korea Intellectual Property Office, International Search Report and Written Opinion, Feb. 26, 2021.

Notification Concerning Transmittal of International Preliminary Report on Patentability for International Application No. PCT/US2020/060709 dated May 27, 2022; 1 pg.

Notification Concerning Transmittal of International Preliminary Report on Patentability for International Application No. PCT/US2020/012562 dated May 27, 2022; 1 pg.

* cited by examiner

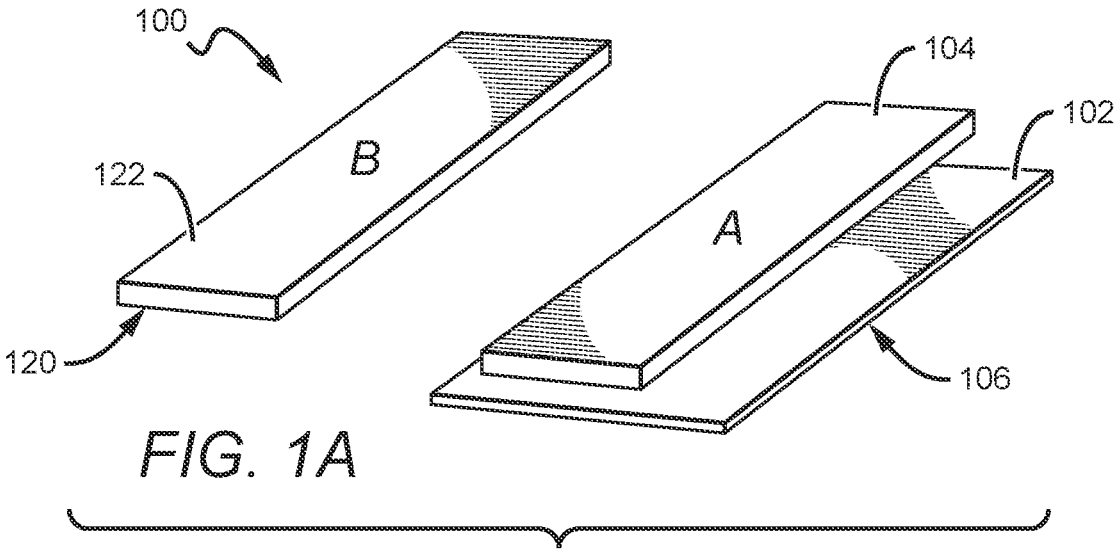
FIG. 1A
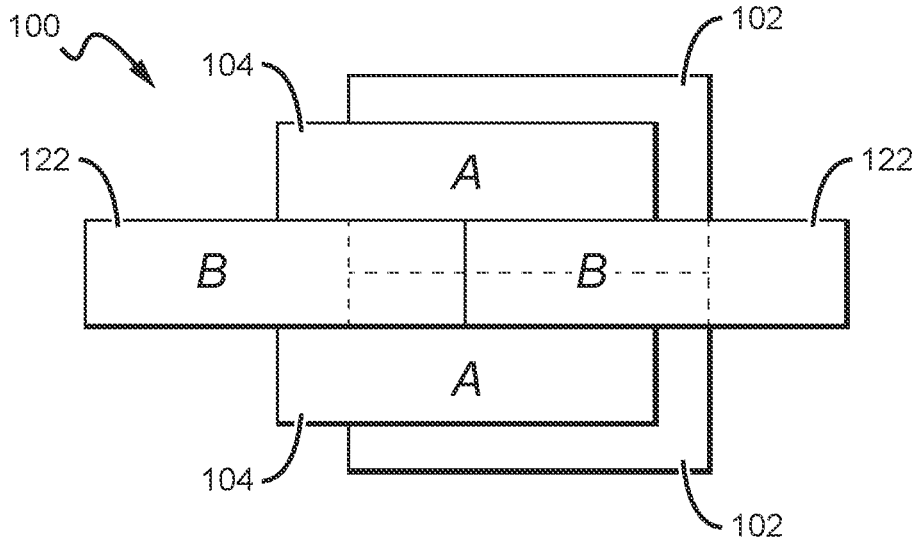
FIG. 1B
FIG. 1C
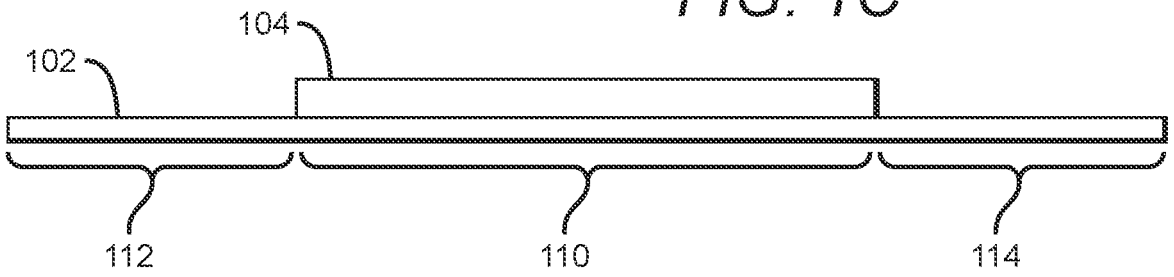

FIG. 3A
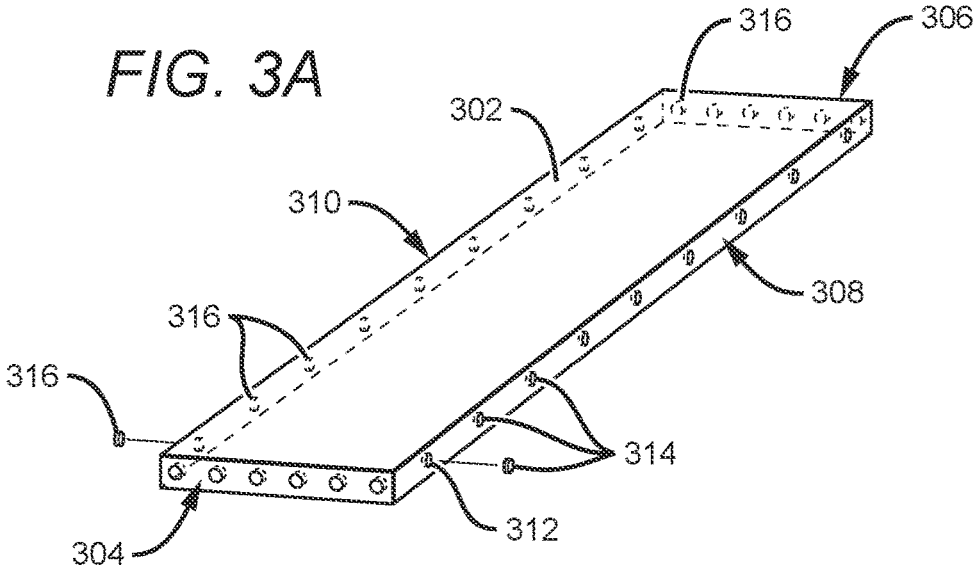
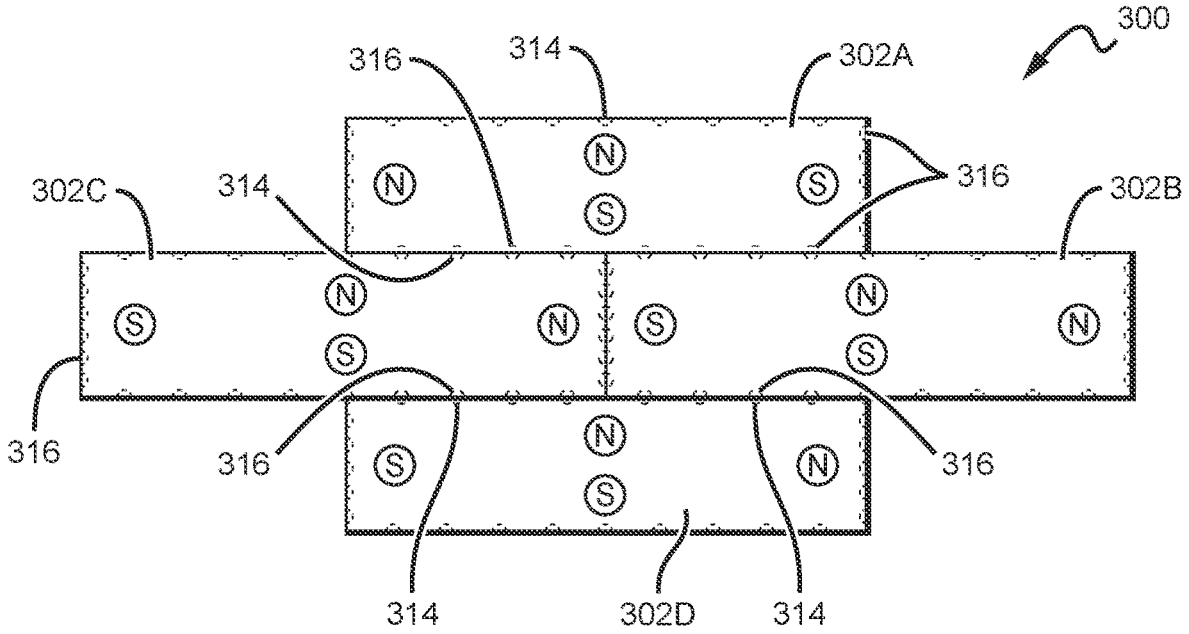
FIG. 3B
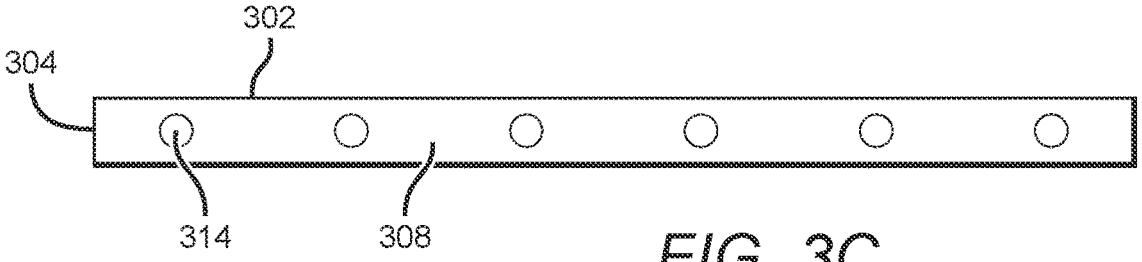
FIG. 3C

LINKABLE TILES FOR COVERING A SURFACE

This application is a continuation-in-part application of U.S. non-provisional application having Ser. No. 16/879,659 filed on May 20, 2020, which is a continuation-in-part application of U.S. non-provisional application having Ser. No. 16/736,371 filed on Jan. 7, 2020 (now U.S. Pat. No. 10,711,467), which itself claims priority to U.S. provisional application having Ser. No. 62/936,470 filed on Nov. 16, 2019. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is interlocking tiles, planks, or devices.

BACKGROUND

The following description includes information that may be useful in understanding the present invention. It is not an admission that any of the information provided herein is prior art or relevant to the presently claimed invention, or that any publication specifically or implicitly referenced is prior art.

In general, flooring tiles and other interlocking tiles comprise a first side with routed edges that are used to interlock adjacent tiles by holding the adjacent tile against the other tile at a slight angle and then pushing the adjacent tile to lock the two tiles together. This solution can prevent quick removal of a single piece of the interlocked tiles due to the nature of each tile being interlocked with neighboring tiles.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for linkable tiles having improved mechanisms for linking adjacent tiles.

SUMMARY OF THE INVENTION

The inventive subject matter provides apparatus, systems and methods for tiles or devices for creating a structure that covers a floor or other surface. In preferred embodiments, a set of tiles or devices are physically and/or magnetically coupled together to form the structure for covering the surface onto which they are laid. Such surface could comprise a floor but could alternatively comprise a wall or other surface. As used herein, the term "tile" and "piece" are defined to include planks and other pieces that can be interconnected to form a structural covering for a floor, wall, or other surface. Tiles and pieces can therefore include, for example, composite flooring such as luxury vinyl flooring or other engineered hardwood flooring that may have multiple layers and/or materials compressed together and solid surface flooring and could be formed from one or more materials such as wood, metals, fiberglass, and so forth.

Commonly, these pieces or devices have an elongated, rectangular shape and typically have a length of between 45-55 inches (114.3 cm-139.7 cm) and a width between 4-12 inches (10.2 cm-30.5 cm). Unlike children's toys, these flooring structures composed of a plurality of interconnected devices or tiles are designed to support significant weight and withstand a variety of forces. Typically, these flooring pieces are designed to withstand weights between 300-500 pounds per square inch.

In some embodiments, the tile or device comprises a composite piece disposed on top of a vinyl sheet and attached to one another. Preferably, a surface area of the vinyl sheet is greater than a surface area of the composite piece. The composite piece is disposed on top of the vinyl sheet in an offset manner, such that a portion of the composite piece is disposed off of the vinyl sheet. At least one of the vinyl sheet and composite piece comprises a magnetized portion.

In preferred embodiments, a portion of the vinyl sheet, and preferably not the portion beneath the composite sheet, comprises the magnetized portion. In this manner, two of these tiles can be placed such that the vinyl sheet of each abuts on one side. A second tile having a set of magnets on a lower surface of the second tile can be placed on at least part of the magnetized portion of the vinyl sheet of each of the two tiles. In this manner, the magnets on the lower surface of the second tile can be coupled to the adjacent vinyl sheets such that the three tiles are coupled with the second tile disposed in between the two other tiles.

In another embodiment, the tile or device comprises first, second, third and fourth sides, with the first and second sides disposed opposite of each other, and the third and fourth sides disposed opposite of each other. In such embodiment, the third and fourth sides are disposed between the first and second sides. The first side preferably comprises a first routed edge having a first slot with first and second opposing inner edges, such that a width of an inner surface of the first slot is greater than a width of an opening of the first slot in the first side.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DRAWINGS

FIGS. 1A-1C illustrate various views of one embodiment of a tile.

FIGS. 3A-3C illustrate various views of another embodiment of a tile.

DETAILED DESCRIPTION

Figure 2A:
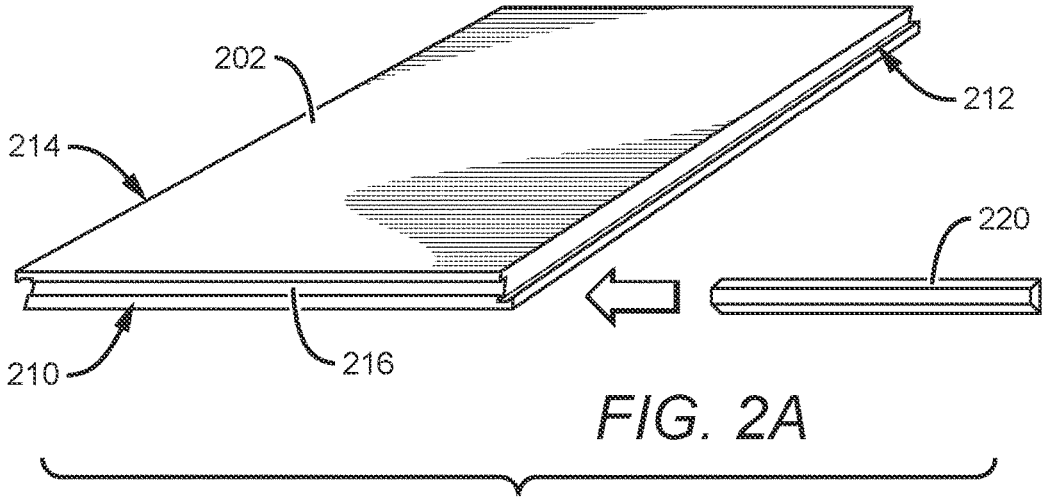
FIGS. 2A-2C illustrate various views of another embodiment of a tile.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

FIGS. 1A-1C illustrate one embodiment of a flooring system 100 for covering a floor or other surface that comprises a first set of tiles A and a second set of tiles B. Although referred to as a flooring system, it is contemplated that the tiles could be used to cover a wall or other surface in addition to flooring.

The first set of tiles A comprises a composite piece 104 that is disposed on top of a vinyl sheet 102. Preferably, a surface area of the vinyl sheet 102 is greater than a surface area of the composite piece 104. It is especially preferred that the composite piece 104 is disposed on top of the vinyl sheet 102 in an offset manner, such that a portion of the composite piece 104 is disposed off the vinyl sheet 102, such as shown in FIG. 1A.

It is preferred that at least one of the vinyl sheet 102 and composite piece 104 comprises a magnetized portion. In the embodiment shown in FIGS. 1A-1C, at least a portion of the vinyl sheet 102 is preferably magnetized to form the magnetized portion 106, and such portion is preferably the portion that is not disposed beneath composite piece 104. Thus, in such embodiments, the vinyl sheet 102 can comprise a first region 110 and a second region 112, wherein the composite piece 104 is disposed on top of the first region 110 and not the second region 112, and wherein the second region 112 comprises the magnetized portion 106. It is contemplated that the vinyl sheet 102 may also comprise a third region 114 on an opposite side of the composite piece 104, which may or may not be magnetized.

However, it is also contemplated that one or more of the sides of the composite piece 104 could comprise one or more magnets.

As discussed above, system 100 can also include a second set of tiles B, which are configured to couple with the tiles A of the first set, such as shown in FIG. 1B. Preferably each tile B of the second set comprises a set of magnets on a lower surface 120. In this manner, the set of magnets on the lower surface 120 magnetically couple with the magnetized surface 106 of the vinyl sheet 102 to thereby couple tile B to tile A.

As shown in FIG. 1B, composite piece 122 of tile B can be placed between adjacent tiles A to thereby connect the three tiles via the intermediate tile B. The tiles A,B,A can be coupled together via the interaction between at least some of the magnets on the lower surface 120 of composite piece 122 and the magnetized portions 106 of the vinyl sheet 102 of tiles A. As shown, tiles B are preferably placed in an offset manner relative to the composite pieces 104 of tiles A.

Although not shown, it is contemplated that one or more sides of the composite piece 122 could have a routed edge that interacts with a routed edge of composite piece 104 to secure the composite pieces thereby further 122 and 104 to one another.

Figure 2B:
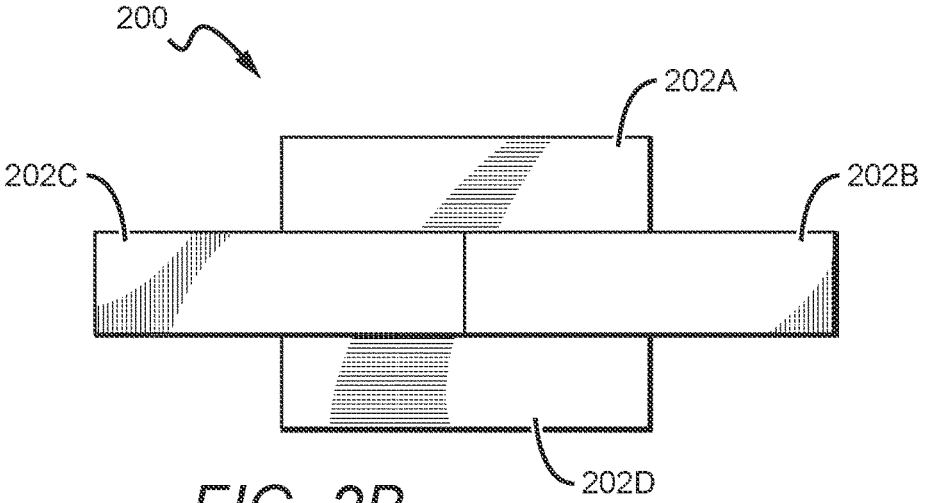
Figure 2C:
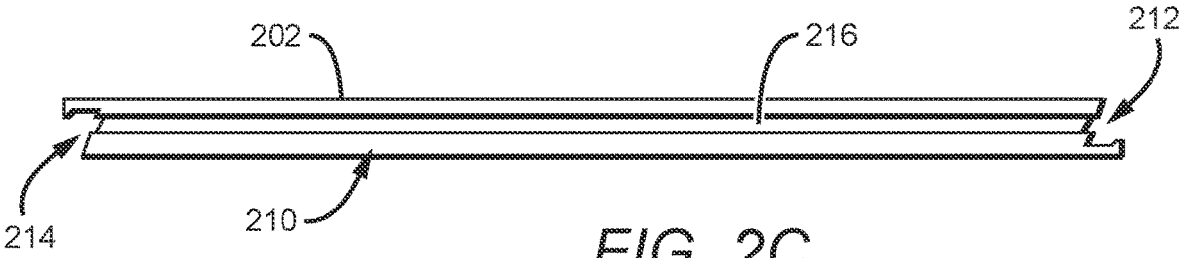

FIGS. 2A-2C illustrate another embodiment of a flooring system 200 for covering a floor or other surface that comprises a set of tiles 202. As shown in FIGS. 2A and 2C, each tile 202 comprises a composite piece having first, second, third and fourth sides forming a rectangular shape with the first and second sides disposed opposite of each other, and the third and fourth sides disposed opposite of each other. In such arrangement, the third side and fourth side are each disposed between the first and second sides. Of course, tile 202 could instead have three sides or five or more sides without departing from the scope of the invention herein.

The first side 210 comprises a routed edge having a slot 216 cut into the first side 210. The slot 216 preferably has first and second opposing sides that extend between an opening of the slot 216 on an outer surface of the first side 210 and an inner surface of the slot 216. A width or diameter of the inner surface of the slot 216 is preferably greater than a width or diameter of the opening of the slot 216.

As shown in FIGS. 2A and 2C, preferably the first and second opposing sides of slot 216 are tapered, such that a cross-section of the slot 216 comprises an isosceles trapezoid shape. In such embodiments, it is contemplated that the slot 216 is configured to receive an insert 220 having a set of magnets coupled to or embedded within the insert 220. Preferably, the insert 220 also comprise a cross-section having an isosceles trapezoid shape. In this manner, the insert 220 can be slidably engaged with the slot 216, and thereby held in place while providing magnets that be used to couple the side 210 of the tile 202 with an adjacent tile having one or more magnets or magnetized surface.

Alternatively, it is contemplated that the slot 216 could comprise a T-shape, an L-shape, or other suitable shape, such that a width or diameter of the inner surface of the slot 216 remains greater than a width or diameter of the opening of the slot 216.

Tile 202 can include a third side having a routed edge 212 and a fourth side having a routed edge 214. Preferably, the routed edge 212 is complementary to the routed edge 214, such that routed edge 214 of an adjacent tile can be connected with routed edge 212 of the tile 202. The adjacent tiles may be coupled in an interlocking manner where the edges are placed together and then moved relative to one another to lock the tiles in place. In such embodiments, it is contemplated that the insert 220 can be used to help prevent the side 210 of the tile 202 from raising or warping over time by the use of the magnetic coupling with an adjacent tile.

It is further contemplated that the second side (opposite of the first side 210) can have a routing to form a slot similar to that of slot 216, and that is configured to receive an insert much like insert 220. In this manner, two of the sides (first and second sides) can have a set of magnets or otherwise be magnetized, and the other two sides (third and fourth sides) can have a routed edge that permits interlocking of an adjacent tile.

As shown in FIG. 2B, multiple tiles 202A-202D can be connected to adjacent tiles to form a flooring. For example, tile 202A can be connected to tiles 202C and 202B via the routed edges of those tiles. Likewise, tile 202D can be connected to tiles 202C and 202B via the routed edges of those tiles. Tiles 202B and 202C can be magnetically coupled to one another via the inserts 220.

FIGS. 3A-3C illustrate another embodiment of a flooring system 300 for covering a floor or other surface that comprises a set of tiles 302. As shown in FIGS. 3A and 3C, each tile 302 comprises a composite piece having a first side 304, a second side 306, a third side 308, and a fourth side 310 forming a rectangular shape with the first and second sides 304, 306 disposed opposite of each other, and the third and fourth sides 308, 310 disposed opposite of each other. In such arrangement, the third side and fourth sides 308, 310 are each disposed between the first and second sides 304, 306. As discussed above, triangular shapes and other shapes are alternatively contemplated.

Each of the sides preferably comprises a set of recessed or notches configured to receive a magnet. Preferably, the magnets are arranged such that the first and third sides 304, 308 have a first polarity and the second and fourth sides 306, 310 have the opposite polarity. Thus, the first and third sides 304, 308 comprises a set of magnets 314 disposed such that the north pole of the magnets 314 face outwardly, and the second and fourth sides 306, 310 comprises a set of magnets 316 disposed such that the south pole of the magnets 316 face outwardly. Of course, the polarity of the magnets of the first and third sides 304, 308 could be swapped with the magnets of the second and fourth sides 306, 310 without departing from the scope of the invention.

As shown in FIG. 3B, multiple tiles 302A-302D can be connected to adjacent tiles to form a flooring. For example, tile 302A can be connected to tiles 302B and 302C via magnets 316 on the fourth side of the tile 302A, and magnets 314 on the second side of tiles 302B and 302C. Likewise, tile 302D can be connected to tiles 302B and 302C via magnets 314 on the second side of the tile 302D, and magnets 316 on the fourth side of tiles 302B and 302C. Tiles 302B and 302C can be magnetically coupled to one another via magnets 314 on the first side of tile 302C and magnets 316 on the second side of tile 302B.

Figure 4A:
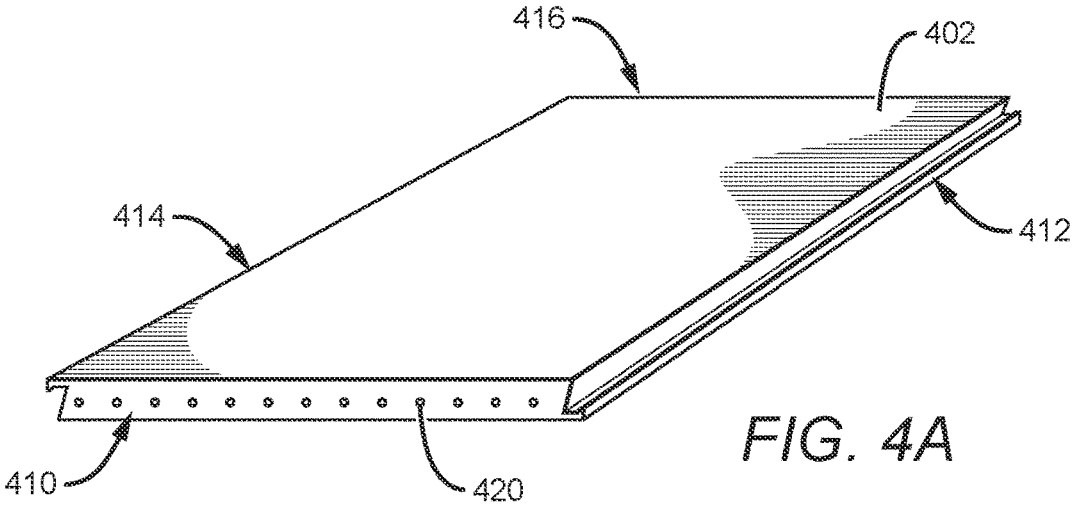
FIGS. 4A-4C illustrate various views of another embodiment of a tile.
Figure 4B:
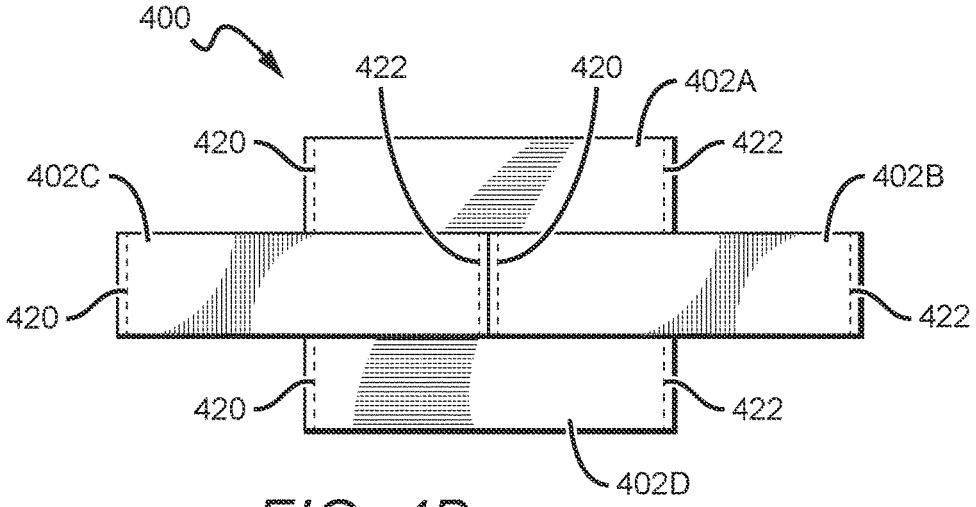
Figure 4C:
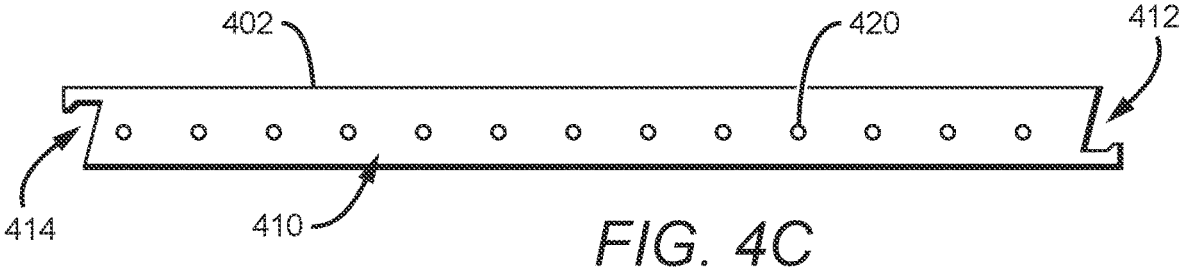

FIGS. 4A-4C illustrate another embodiment of a flooring system 400 for covering a floor or other surface that comprises a set of tiles 402. As shown in FIGS. 4A and 4C, each tile 402 comprises a composite piece having a first side 410, a second side 416, a third side 412, and a fourth side 414 forming a rectangular shape with the first and second sides 410, 416 disposed opposite of each other, and the third and fourth sides 412, 414 disposed opposite of each other. In such arrangement, the third side and fourth sides 412, 414 are each disposed between the first and second sides 410, 416. As discussed above, triangular shapes and other shapes are alternatively contemplated.

The first side 410 preferably comprises a set of magnets 420 embedded or otherwise coupled to the first side 410. Similarly, the second side 416 can comprise a second set of magnets 422 having a polarity that is opposite those of the set of magnets 420.

Tile 402 can include a third side 412 having a first routed edge and a fourth side 414 having a second routed edge. As shown, the first and second routed edges can be complementary to one another, such that a first routed edge of a first tile can connect and interlock with a second routed edge of an adjacent tile. The adjacent tiles may be coupled in an interlocking manner where the edges are placed together and then moved relative to one another to lock the tiles in place. In such embodiments, it is contemplated that the interaction of magnets 420 of one tile and magnets 422 of the adjacent tile can be used to help prevent the first and second sides of the tiles from raising or warping over time by the use of the magnetic coupling with adjacent tiles.

Thus, like the tile shown in FIGS. 2A and 2C, two of the sides (first and second sides) can have a set of magnets or otherwise be magnetized, and the other two sides (third and fourth sides) can have a routed edge that permits interlocking of an adjacent tile.

As shown in FIG. 4B, multiple tiles 402A-402D can be connected to adjacent tiles to form a flooring. For example, tile 402A can be connected to tiles 402C and 402B via the routed edges of those tiles. Likewise, tile 402D can be connected to tiles 402C and 402B via the routed edges of those tiles. Tiles 402B and 402C can be magnetically coupled to one another via magnets 420 and magnets 422, respectively.

Figure 5A:
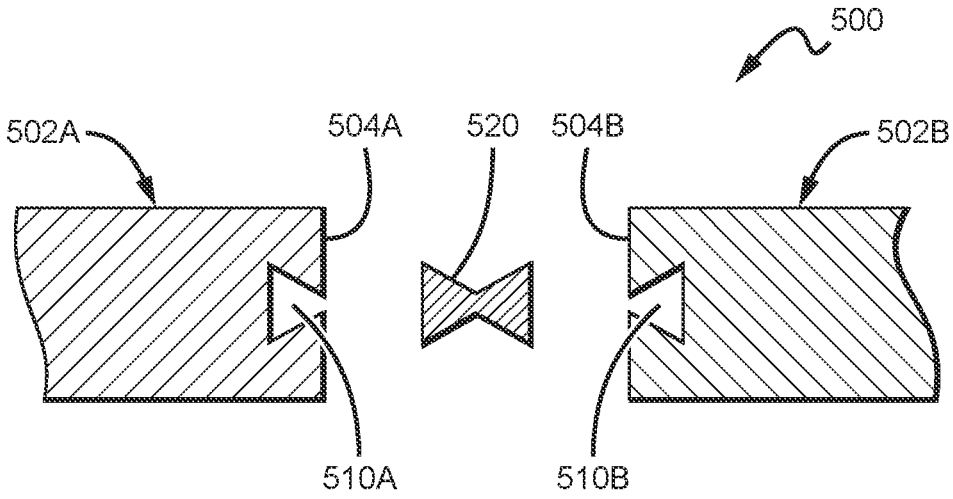
FIGS. 5A-5B illustrate side views of another embodiment of a tile.
Figure 5B:
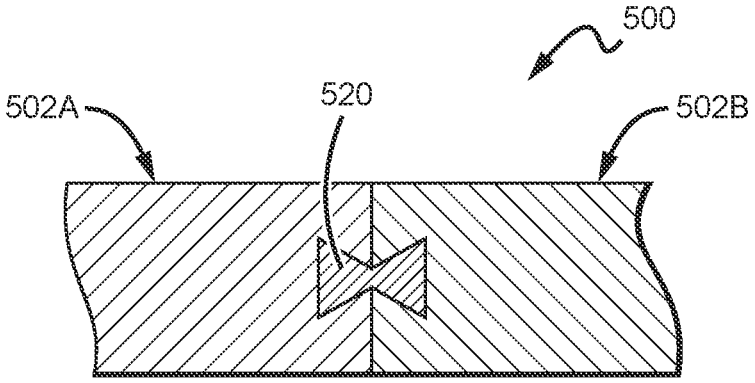

FIGS. 5A-5B illustrate another embodiment of a flooring system 500 for covering a floor or other surface that comprises a set of tiles 502A, 502B. Tile 502A can have a first side 504A with a slot 510A formed in the side 504A. Similarly, tile 502B can have a first side 504B with a slot 510B formed in the side 504B.

Slots 510A, 510B preferably comprises first and second opposing sides that extend between an opening of each slot 510A, 510B on an outer surface of the first side 504A, 504B, respectively, and an inner surface of each slot 510A, 510B. A width or diameter of the inner surface of each slot 510A, 510B is preferably greater than a width or diameter of the opening of each slot 510A, 510B.

As shown, preferably the first and second opposing sides of each slot 510A, 510B are tapered, such that a cross-section of each slot 510A, 510B comprises an isosceles trapezoid shape. In such embodiment, it is contemplated that each slot 510A, 510B is configured to receive a portion of an insert 520.

When the insert 520 is received by both of the slots 510A, 510B, tile 502A and tile 502B are connected to one another.

Alternatively, it is contemplated that the slots 510A, 510B could comprise a T-shape, an L-shape, or other suitable shape, such that a width or diameter of the inner surface of each slot 510A, 510B remains greater than a width or diameter of the opening of each slot 510A, 510B. In such embodiments, it is contemplated that the shape of the insert could be likely varied to an I-shape (for T-shaped slots) or a C-shape (for L-shaped slots), for example.

Although not shown, it is contemplated that each of tiles 502A and 502B can include opposing sides having routed edges that are preferably complementary to one another, such that routed edge of one tile can be connected with routed edge of the adjacent tile.

Figure 6B:
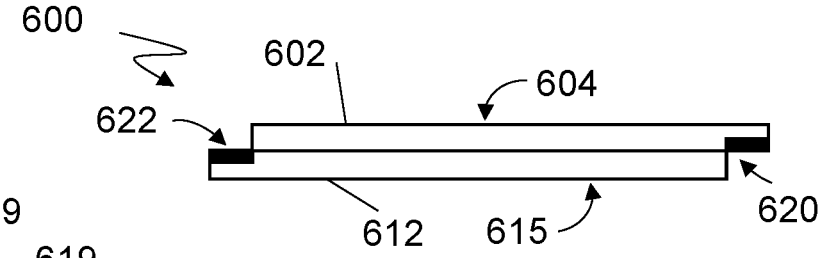
FIGS. 6A-6B illustrate top and side views, respectively, of one embodiment of a device for creating a flooring structure.
Figure 6A:
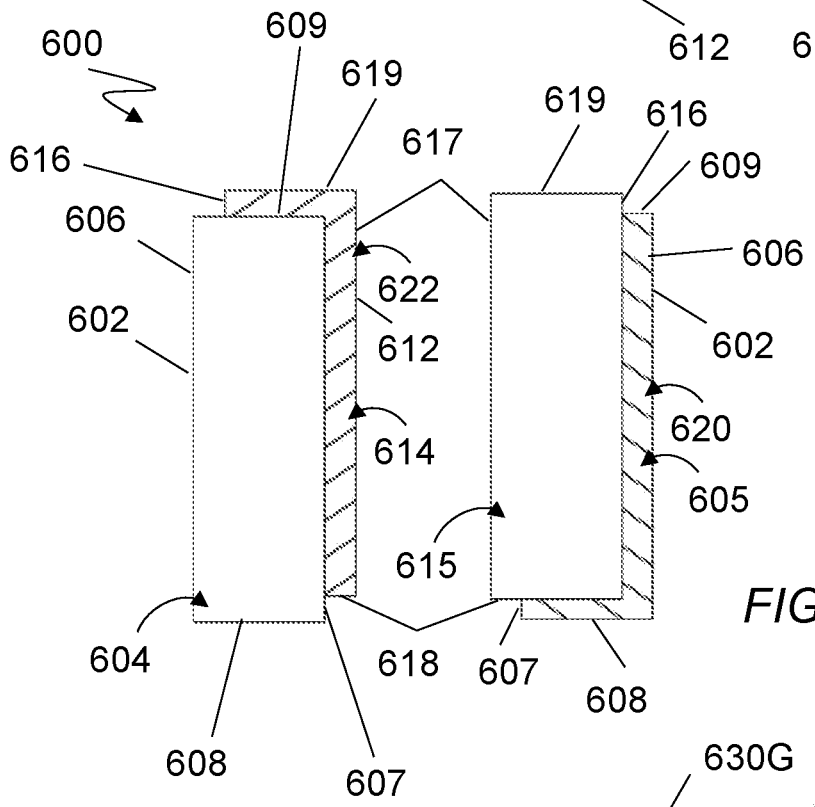

FIGS. 6A-6B illustrate another embodiment of a device 600 for covering a floor or other surface. Device 600 comprises a first piece 602 and a second piece 612 which are attached or permanently affixed to one another to form the device 600. Preferably, the first piece 602 is disposed above or on top of the second piece 612, such that the first piece 602 partially covers the second piece 612. It is especially preferred that the first piece 602 is disposed on top of the second piece 612 in an offset manner, such that a portion of the first piece 602 is disposed off of the second piece 612.

The first piece 602 comprises a top surface 604 and a bottom surface 605. Preferably, the first piece 602 comprises an elongated rectangular shape having a first side 606, a second side 607, a third side 608 and a fourth side 609. As shown, the first side 606 and the second side 607 are disposed opposite of one another, and the third side 608 and the fourth side 609 are disposed opposite of one another and between the first and second sides 606, 607.

The second piece 612 also comprises a top surface 614 and a bottom surface 615. Preferably, the second piece 612 comprises an elongated rectangular shape having a first side 616, a second side 617, a third side 618 and a fourth side 619. As shown, the first side 616 and the second side 617 are disposed opposite of one another, and the third side 618 and the fourth side 619 are disposed opposite of one another and between the first and second sides 616, 617.

Of course, it is contemplated that the device 600 and first piece 602 and/or second piece 612 may comprise a square shape or other commercially suitable shape without departing from the scope of the invention herein.

As shown in FIG. 6A, a first portion 622 of the upper surface 614 of the second piece 612 (shown in hatched lines) may be magnetized. This could be accomplished, for example, by embedding or otherwise coupling one or more magnets or ferrous material to the first portion 622. A first portion 620 of the lower surface 605 of the first piece 602 may also be magnetized using magnets or other ferrous material or other commercially suitable means.

The magnetized first portion 620 of the first piece 602 and the magnetized first portion 622 of the second piece 612 are also shown in FIG. 6B. Preferably, the magnetized first portion 620 of the first piece 602 has a polarity that is opposite a polarity of the magnetized first portion 622 of the second piece 612.

One or both of the pieces 602, 612 may comprise a composite material or may be formed from solid wood or another material for example. In some embodiments, one or both of the pieces 602, 612 comprises a flooring plank that may or may not be a composite and that can be connected or coupled with other pieces to form a decorative flooring surface.

In some embodiments, it is contemplated that one or more of the sides of the first piece 602 or the second piece 612 could comprise one or more magnets.

In other embodiments, it is contemplated that one or more sides of the first piece 602 or the second piece 612 could have a routed edge that interacts with a routed edge of a piece of an adjacent device to further secure the adjacent devices to one another.

Figure 6C:
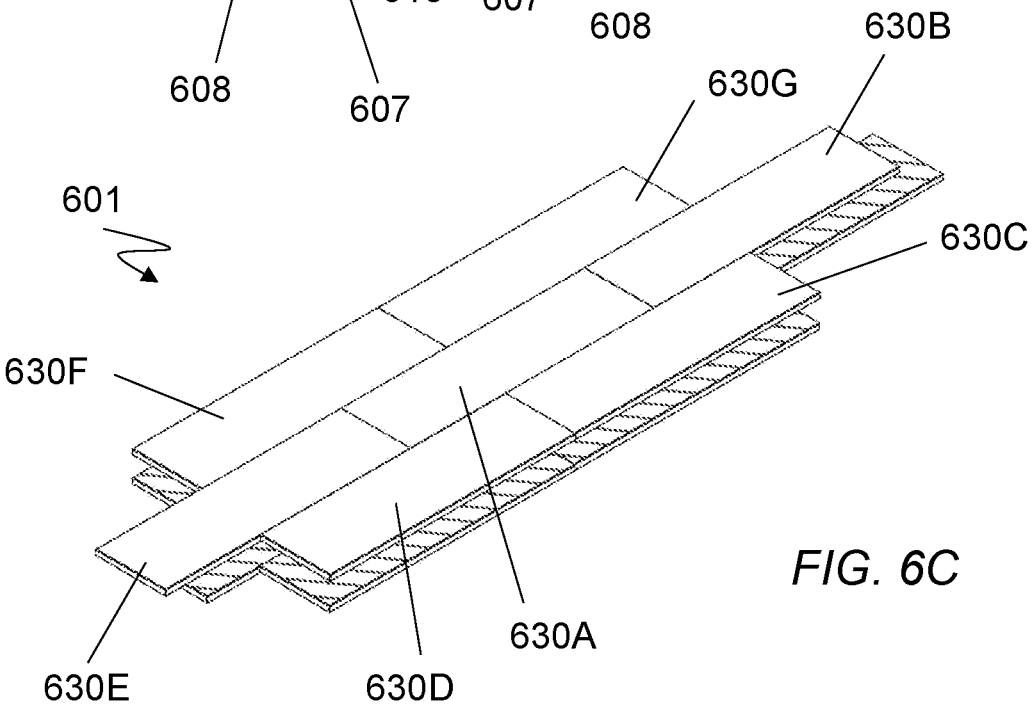
FIG. 6C illustrates a perspective view of the flooring structure formed of devices of FIG. 6A.

FIG. 6C illustrates a flooring structure 601 for covering a floor or other surface that comprises a plurality of the devices 600 shown in FIGS. 6A-6B. As shown, device 630A can be magnetically coupled with adjacent devices 630B-630G to form the flooring structure 601. Although referred to as a flooring structure, it is contemplated that the pieces could be used to cover a wall or other surface in addition to a floor.

As shown, the magnetized portion of one of the devices can interact with the magnetized portion of an adjacent device to thereby magnetically couple adjacent devices.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device used to create a structure covering a floor or other surface, comprising:

a first piece comprising a top surface and a bottom surface, wherein the bottom surface comprises a magnetized first portion and a non-magnetized second portion;

a second piece comprising a top surface and a bottom surface, wherein the top surface comprises a magnetized portion and a non-magnetized second portion; and wherein the first piece and the second piece are permanently affixed to one another in an offset manner, such that the first piece and the second piece do not entirely overlap; and wherein that the non-magnetized second portion of the bottom surface of the first piece is attached to the non-magnetized second portion of the top surface of the second piece.

2. The device of claim 1, wherein the magnetized portion of the first piece has a first polarity and the magnetized portion of the second piece has a second polarity that is opposite the first polarity.

3. The device of claim 1, wherein the first piece comprises first, second, third and fourth sides, wherein the first and second sides are disposed opposite of each other, and the third and fourth sides are disposed opposite of each other and disposed between the first and second sides, and wherein the second piece comprises first, second, third and fourth sides, wherein the first and second sides are disposed opposite of each other, and the third and fourth sides are disposed opposite of each other and disposed between the first and second sides.

4. The device of claim 3, wherein the first piece and the second piece each comprises an elongated rectangular shape.

5. The device of claim 1, wherein the first piece is disposed on top of the second piece, such that the first piece only partially covers the second piece.

6. The device of claim 1, wherein the magnetized portion of the first piece comprises a set of magnets or ferrous material.

7. The device of claim 1, wherein the magnetized portion of the second piece comprises a set of magnets or ferrous material.

8. The device of claim 1, wherein each of the first and second pieces comprises an engineered composite material or solid wood.

9. The device of claim 1, wherein each of the first and second pieces comprises a plurality of layers compressed together to form a composite material, and wherein the first and second pieces collectively form a flooring plank comprising a luxury vinyl flooring piece configured to magnetically interlock with adjacent devices to create the structure.

10. The device of claim 1, wherein at least one of the sides of the first piece comprises a routed edge.

11. The device of claim 1, wherein at least one of the sides of the first piece comprises a set of magnets.

12. A flooring structure of interconnected devices for covering a floor, comprising:

a first device comprising the device of claim 1;

a second device comprising the device of claim 1; and wherein the magnetized portion of the second piece of the first device magnetically couples with the magnetized portion of the first piece of the second device, when the first and second devices are adjacent to one another.

13. The flooring structure of claim 12, further comprising:

a third device comprising the device of claim 1; and wherein the magnetized portion of the first piece of the first device magnetically couples with the magnetized portion of the second piece of the third device, when the first and third devices are adjacent to one another.

* * * * *